US008737866B2

(12) United States Patent
Shiori et al.

(10) Patent No.: US 8,737,866 B2
(45) Date of Patent: May 27, 2014

(54) IMAGE FORMING APPARATUS INCLUDING A CONTROLLER TO CONTROL A COOLING DEVICE TO COOL THE IMAGE FORMING APPARATUS

(75) Inventors: Jun Shiori, Kanagawa (JP); Jun Yura, Kanagawa (JP); Yukiko Iwasaki, Kanagawa (JP); Masaki Sukesako, Kanagawa (JP); Hiroyuki Sugiyama, Kanagawa (JP); Kazuaki Kamihara, Tokyo (JP); Hironobu Takeshita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 339 days.

(21) Appl. No.: 13/251,512

(22) Filed: Oct. 3, 2011

(65) Prior Publication Data

US 2012/0093528 A1 Apr. 19, 2012

(30) Foreign Application Priority Data

Oct. 13, 2010 (JP) ..... 2010-230723

(51) Int. Cl.
*G03G 21/20* (2006.01)
*G03G 15/00* (2006.01)

(52) U.S. Cl.
USPC ..... 399/94; 399/43

(58) Field of Classification Search
USPC ..... 399/92, 53, 94, 43, 44
See application file for complete search history.

(56) References Cited

U.S. PATENT DOCUMENTS 4,942,431 A * 7/1990 Tada ..... 399/44
5,170,210 A * 12/1992 Saruwatari ..... 399/44
7,593,652 B2 9/2009 Takahashi et al.
7,676,164 B2 3/2010 Shiori et al.
7,734,200 B2 6/2010 Sugiyama et al.
2005/0095015 A1* 5/2005 Arai ..... 399/44
2009/0279910 A1 11/2009 Shiori
2011/0026958 A1 2/2011 Shiori

FOREIGN PATENT DOCUMENTS

JP 9-26745 1/1997
JP 2936146 6/1999
JP 3073271 6/2000
JP 2002-215005 7/2002

OTHER PUBLICATIONS

U.S. Appl. No. 13/207,949, filed Aug. 11, 2011, Shiori, et al.

* cited by examiner

*Primary Examiner* — Susan Lee
(74) *Attorney, Agent, or Firm* — Oblon, Spivak, McClelland, Maier & Neustadt, L.L.P.

(57) ABSTRACT

An image forming apparatus includes a developing device including a developing roller to bear a developing agent to develop a latent image formed on an image bearing member, a cooling device to reduce an internal temperature of the image forming apparatus, a controller to calculate a travel distance of the developing roller to control the cooling device, and a memory unit to store the total travel distance of the developing roller. The controller calculates the total travel distance of the developing roller every Y minutes in the last X minutes, and a difference between the latest total travel distance of the developing roller and the total travel distance stored Z minutes ago by the memory unit to obtain the total travel distance during Z minutes and operate the cooling device for W minutes after image forming operation where the difference is equal to or greater than a threshold value M.

15 Claims, 6 Drawing Sheets

IMAGE FORMING APPARATUS INCLUDING A CONTROLLER TO CONTROL A COOLING DEVICE TO COOL THE IMAGE FORMING APPARATUS

CROSS-REFERENCE TO RELATED APPLICATIONS

This patent application is based on and claims priority pursuant to 35 U.S.C. §119 to Japanese Patent Application No. 2010-230723, filed on Oct. 13, 2010, in the Japan Patent Office, the entire disclosure of which is hereby incorporated by reference herein.

FIELD OF THE INVENTION

Exemplary aspects of the present invention generally relate to an electrophotographic image forming apparatus, such as a copier, a facsimile machine, a printer, or a multi-functional system including a combination thereof, and more particularly to an image forming apparatus including a cooling device that reduces internal temperature of the image forming apparatus.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

During image forming operation, the internal temperature of the image forming apparatus rises. In order to prevent overheating of devices in the image forming apparatus, a cooling device such as a fan is provided to the image forming apparatus.

In a known approach, the cooling device is activated when the number of scanned pages or printed pages or cumulative image forming time reaches a threshold value. Typically, after the image forming operation, the cooling device is stopped.

However, after an extended period of continuous operation of the image forming apparatus, the temperature of the developing device employed in the image forming apparatus rises, causing toner in the developing device to melt prematurely and hence degrading imaging quality. Moreover, because the temperature of the developing device is difficult to detect directly it continues to rise if left unchecked.

In order to cool the developing device, the cooling device may be operated continuously even after image forming operation ends. Although effective, continuous operation of the cooling device increases power consumption and produces noise, complicating efforts to reduce power consumption as is usually desired.

SUMMARY OF THE INVENTION

In view of the foregoing, in one illustrative embodiment of the present invention, an image forming apparatus includes an image bearing member, a developing device, a cooling device, a controller, and a memory unit. The image bearing member bears a latent image on a surface thereof and rotates in a certain direction. The developing device including a developing roller bears a developing agent to develop the latent image formed on the image bearing member using the developing agent to form a toner image. The cooling device reduces an internal temperature of the image forming apparatus by blowing air. The controller calculates a travel distance of the developing roller to control operation of the cooling device. The memory unit stores the total travel distance of the developing roller obtained by the controller. The controller calculates the total travel distance of the developing roller every predetermined interval Y within a last elapsed period of time X and calculating a difference D between the latest total travel distance of the developing roller and the total travel distance stored a given time period Z ago by the memory unit so as to obtain the total travel distance during Z and operate the cooling device for a predetermined period of time W after image forming operation ends where the difference D is equal to or greater than a threshold value M.

In another illustrative embodiment of the present invention, an image forming apparatus includes bearing means, developing means, cooling means, controlling means, and storing means. The bearing means bears a latent image. The developing means develops the latent image using a developing agent to form a toner image. The cooling means reduces an internal temperature of the image forming apparatus by blowing air. The controlling means calculates a travel distance of the developing means to control operation of the cooling means. The storing means stores the total travel distance of the developing means obtained by the controlling means. The controlling means calculates the total travel distance of the developing roller every predetermined interval Y within a last elapsed period of time X and calculates a difference D between the latest total travel distance of the developing means and the total travel distance stored a given time period Z ago by the storing means so as to obtain the total travel distance during Z and operate the cooling means for a predetermined period of time W after image forming operation ends where the difference is equal to or greater than a threshold value M.

In yet another illustrative embodiment of the present invention, a method for use in the image forming apparatus includes bearing a latent image on a surface thereof, developing the latent image using a developing agent, reducing an internal temperature of the image forming apparatus by blowing air, calculating a travel distance of the developing roller, controlling operation of the cooling device based on the travel distance of the developing roller, and storing the total travel distance of the developing roller. The calculating includes calculating the total travel distance of the developing roller every predetermined interval Y within a last elapsed period of time X and calculating a difference D between the latest total travel distance of the developing roller and the total travel distance stored a given time period Z ago by the storing so as to obtain the total travel distance during Z and operate the cooling device for a period of time W after image forming operation ends where the difference D is equal to or greater than a threshold value M.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF THE INVENTION

Figure 1:
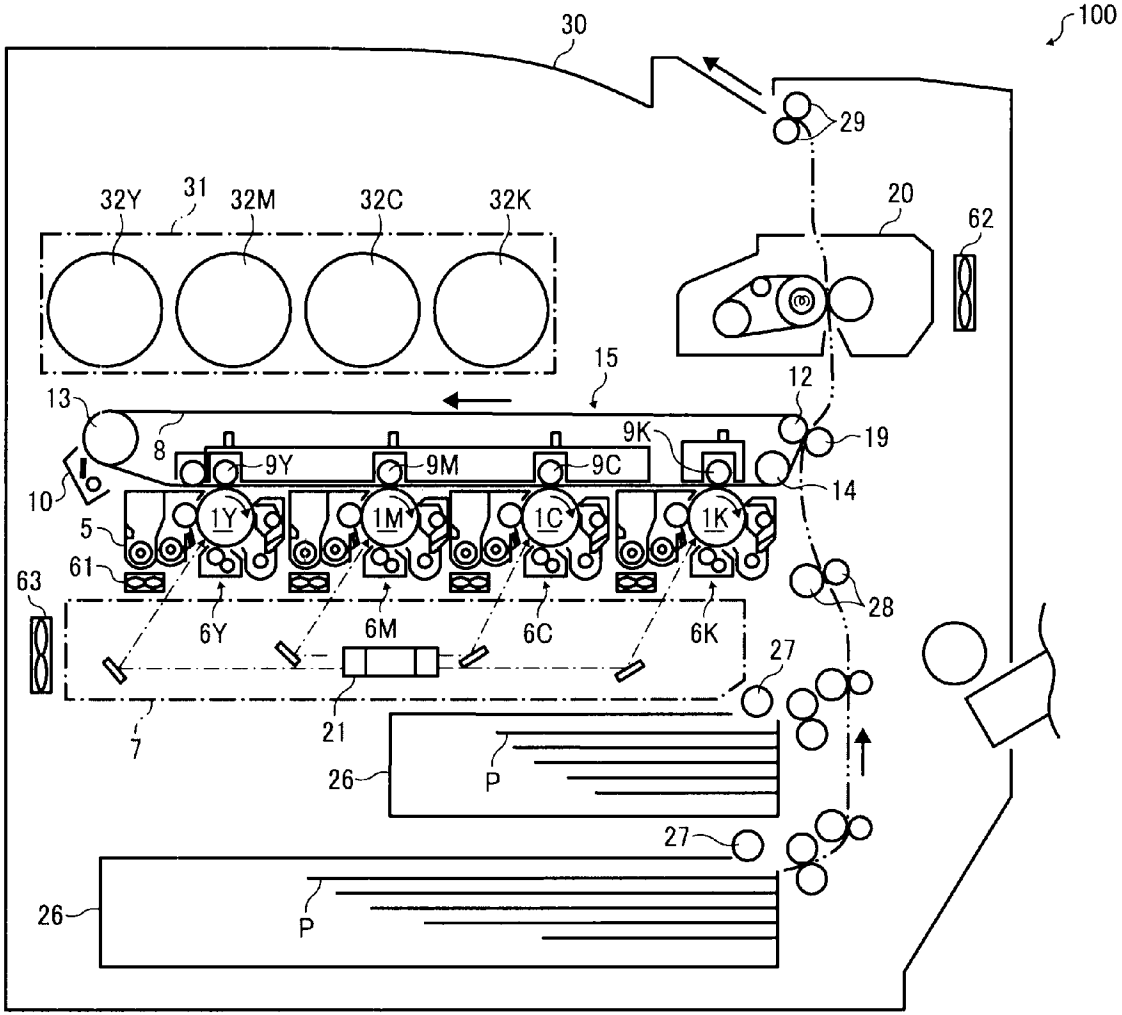
FIG. 1 is a schematic diagram illustrating an image forming apparatus according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Figure 2:
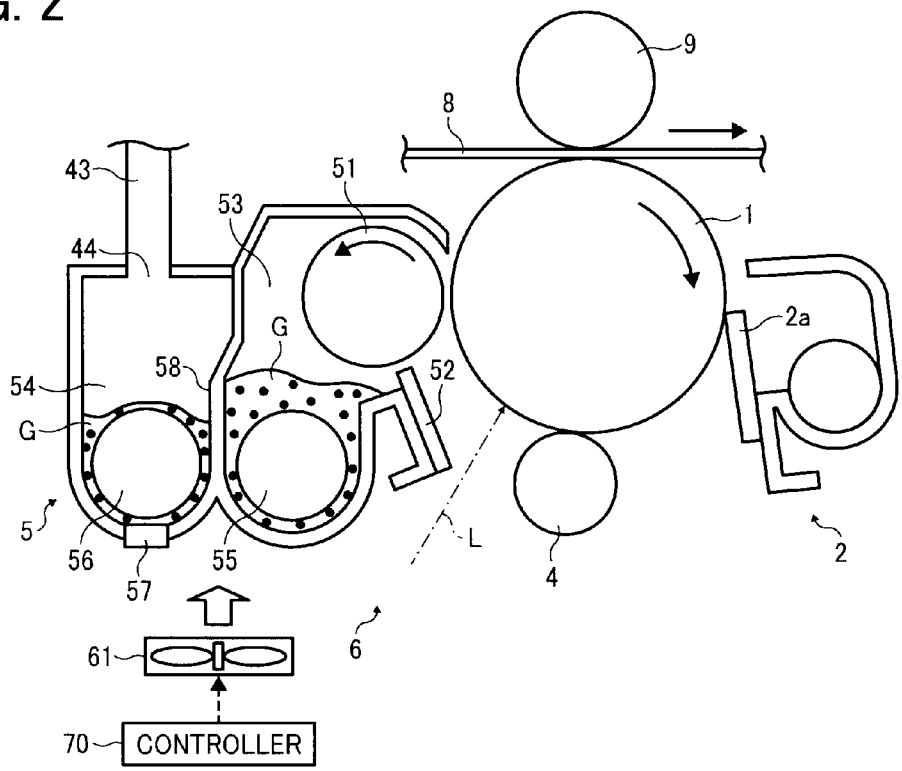
FIG. 2 is a schematic diagram illustrating an image forming unit (process cartridge) employed in the image forming apparatus of FIG. 1.
Figure 3:
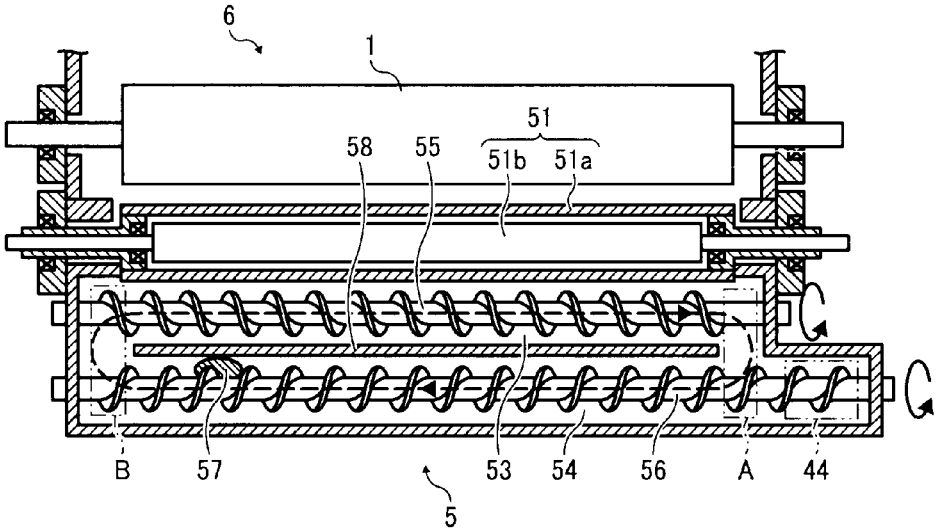
FIG. 3 is a schematic cross-sectional view of a developing device and a photoconductive drum as viewed from the top.

Referring now to the drawings, wherein like reference numerals designate identical or corresponding parts throughout the several views, and initially with reference to FIGS. 1 through 3, a description is provided of an image forming apparatus.

FIG. 1 is a schematic diagram illustrating a laser printer as an example of the image forming apparatus according to an illustrative embodiment of the present invention. FIG. 2 is a schematic cross-sectional view of a process cartridge 6 serving as an image forming unit. FIG. 3 is a schematic cross-sectional view of a developing device 5 and a photoconductive drum 1 in a longitudinal direction as viewed from the top (in a direction perpendicular to a plane of FIG. 2).

As illustrated in FIG. 1, an image forming apparatus 100 includes an intermediate transfer unit 15, process cartridges 6Y, 6M, 6C, and 6K each serving as an image forming unit, an exposure device 7, a fixing device 20, a toner storage unit 31, a sheet feed unit 26, and so forth. The intermediate transfer unit 15 includes an intermediate transfer belt 8 formed into a loop and wound around a plurality of rollers. The process cartridges 6Y, 6M, 6C, and 6K for the colors yellow, magenta, cyan, and black, respectively, are arranged outside the loop formed by the intermediate transfer belt 8, facing the intermediate transfer belt 8.

It is to be noted that the suffixes Y, M, C, and K indicate the colors yellow, magenta, cyan, and black, respectively. The process cartridges 6Y, 6M, 6C, and 6K all have the same configuration as all the others, differing only in the color of toner employed. To simplify the description, these suffixes Y, M, C, and K indicating colors are omitted FIGS. 2 and 3, unless otherwise specified.

With reference to FIG. 2, a description is provided of the process cartridge 6 serving as the image forming unit. A photoconductive drum 1 serving as an image bearing member, a charging device 4, a developing device 5, and a cleaning device 2 constitute a single integrated unit as the process cartridge 6. The process cartridge 6 is detachably installed in the image forming apparatus 100. The charging device 4, the developing device 5, and the cleaning device 2 are disposed around the photoconductive drum 1. Constituting image forming devices such as the photoconductive drum 1, the charging device 4, the developing device 5, and the cleaning device 2 as a single integrated unit can facilitate maintenance of the image forming unit.

Image forming operation including charging, exposing, development, transfer, cleaning, and neutralization of electric charges are performed on the photoconductive drum 1, thereby forming a toner image of a respective color.

According to the illustrative embodiment, the photoconductive drum 1, the charging device 4, the developing device 5, and the cleaning device 2 constitute a single integrated unit as the process cartridge 6. Alternatively, these devices may be detachably installed independently in the image forming apparatus 100. More specifically, the developing device 5 alone can be detachably installed in the image forming apparatus 100. Alternatively, the developing device 5 and at least one of the photoconductive drum 1, the charging device 4, and the cleaning device 2 may be constituted as a single integrated unit detachably installed in the image forming apparatus 100.

As illustrated in FIG. 2, the photoconductive drum 1 rotates in a clockwise direction by a drive motor, not illustrated. When the surface of the photoconductive drum 1 comes to face the charging device 4, the photoconductive drum 1 is uniformly charged by the charging device 4. This is known as a charging process. Subsequently, the exposure device 7 illuminates the surface of the photoconductive drum 1 with light L, thereby forming an electrostatic latent image on the photoconductive drum 1. This is known as an exposure process.

As the surface of the photoconductive drum 1 bearing the electrostatic latent image comes to face the developing device 5, the electrostatic latent image is developed with toner, thereby forming a toner image of a respective color. This is known as a developing process. A two-component developing agent G consisting of toner particles and carriers (magnetic carriers) is stored in the developing device 5.

The density of toner in the developing agent G, that is, a ratio of toner in the developing agent G in the developing device 5, is detected by a magnetic detector 57 serving as a toner density detector and adjusted to be within a certain range. In other words, in accordance with consumption of toner in the developing device 5, new toner is supplied to a second chamber 54 (second transport path) from a toner supply opening 44 connected to a toner transport tube 43. The magnetic detector 57 detects changes in the toner density based on a change in the magnetic permeability of the developing agent flowing around the magnetic detector 57.

Referring back to FIG. 1, the toner storage unit 31 is disposed at the upper portion of the image forming apparatus 100 and includes toner bottles 32Y, 32M, 32C, and 32K storing toner of yellow, magenta, cyan, and black, respectively. The toner transport tube 43 is connected to each of the respective toner bottles 32 in the toner storage unit 31. Although not illustrated, a toner transport system includes a driving unit to rotate the toner bottles 32Y, 32M, 32C, and 32K, an air pump connected to the toner transport tube 43, and so forth. The toner transport system as described above supplies toner from the toner bottles 32Y, 32M, 32C, and 32K to the respective developing devices 5 via the toner transport tube 43.

It is to be noted that the toner transport system is not limited to the configuration described above. For example, toner is supplied to the developing device 5 without the toner transport tube. In this case, toner may be supplied to the developing device 5 from the toner bottle via a connecting hopper.

Subsequently, the toner supplied to the second chamber 54 is mixed with the developing agent G by a second transport screw 56 and a first transport screw 55 and circulates in a direction of dotted arrow shown in FIG. 3 in a first chamber 53 (first transport path) and the second chamber 54 separated by a separator 58.

More specifically, as illustrated in FIG. 3, the developing agent G in the first chamber 53 serving as a first developing agent storage is transported from the left to the right in the longitudinal direction of a developing roller 51 serving as a developing agent bearing member by the first transport screw 55 serving as a first developing agent transport member. By contrast, the developing agent G in the second chamber 54 serving as a second developing agent storage is transported from the right to the left in FIG. 3 by the second screw 56 serving as a second developing agent transport member.

The separator 58 separates the first chamber 53 and the second chamber 54 except each end of the first chamber 53 and the second chamber 54 in the longitudinal direction so that the first chamber 53 and the second chamber 54 are connected at each end (indicated by reference characters A and B) in the longitudinal direction.

The developing agent G transported to the downstream side of the first chamber 53 by the first transport screw 55 flows to the upstream of the second chamber 54 through a first connecting portion A. Subsequently, the developing agent G is transported in the longitudinal direction by the second transport screw 56. The developing agent G transported to the downstream of the second chamber 54 by the second transport screw 56 flows to the upstream of the first chamber 53 through a second connecting portion B. Subsequently, the developing agent G is transported in the longitudinal direction by the first transport screw 55. Accordingly, a circulation path of the developing agent G in the longitudinal direction is formed between the first chamber 53 and the second chamber 54.

The toner in the developing agent G circulating in the circulation path adheres to the carriers due to frictional charging with the carriers. Then, the toner and the carriers are borne on the developing roller 51 on which a plurality of magnetic poles are formed.

As illustrated in FIG. 3, the developing roller 51 includes a magnet 51*b* fixed to the interior of the developing roller 51 and a sleeve 51*a* that rotates around the magnet 51*b*. The magnet 51*b* forms the plurality of magnetic poles on a circumferential surface of the developing roller 51. As the sleeve 51*a* rotates around the magnet 51*b* having the plurality of magnetic poles, the developing agent G moves on the developing roller 51 (on the sleeve 51*a*). The developing roller 51 is rotated in a counterclockwise direction indicated by an arrow in FIG. 2 by a drive motor 71 (shown in FIG. 4) connected to a shaft of the sleeve 51*a*.

The developing agent G borne on the developing roller 51 is transported as the developing roller 51 rotates in the direction of arrow and comes to a position facing a doctor blade 52. The doctor blade 52 serves as a developing agent regulator and is disposed below the developing roller 51. Subsequently, after an amount of the developing agent G on the developing roller 51 is adjusted to a proper amount by the doctor blade 52, the developing agent G is transported to a developing area opposite a photoconductive drum 1 (shown in FIG. 1). An electric field (development electric field) formed in the developing area causes the toner to stick to the latent image formed on the photoconductive drum 1.

Although not illustrated, the plurality of magnetic poles is formed around the developing roller 51 (the sleeve 51*a*) by the magnet 51*b*. The plurality of the magnetic poles consists of a main magnetic pole formed opposite the photoconductive drum 1, a drawing magnetic pole (doctor blade opposing magnetic pole), a separation magnetic pole, a transport magnetic pole, and so forth. The drawing magnetic pole (doctor blade opposing magnetic pole) is formed from a position opposite the first transport screw 55 to the position opposite the doctor blade 52 to draw the developing agent G. The separation magnetic pole is formed above the first chamber 53. The transport magnetic pole is formed between the main magnetic pole and the separation magnetic pole.

The drawing magnetic pole acts on the carriers that are magnetic substance. Accordingly, a portion of the developing agent G traveling in the first chamber 53 is borne on the developing roller 51. The portion of the developing agent G borne on the developing roller 51 is scraped by the doctor blade 52 and returned to the first chamber 53. By contrast, the developing agent G passing through a gap between the doctor blade 52 and the developing roller 51 is borne on the developing roller 51 at the doctor blade 52 on which the drawing magnetic pole acts. The developing agent G on the developing roller 51 forms a brush-like shape as a magnetic brush and slidably contacts the photoconductive drum 1. Accordingly, the toner in the developing agent G borne on the developing roller 51 sticks to the latent image on the photoconductive drum 1.

Subsequently, the developing agent G passing by the main magnetic pole is transported to the separation magnetic pole by the transport magnetic pole. A repulsive electric field acts on the carriers at the separation magnetic pole, thereby separating the developing agent G borne on the developing roller 51 from the developing roller 51 after the development process.

The developing agent G separated from the developing roller 51 is returned to the first chamber 53 again and transported to the downstream of the first chamber 53. Subsequently, the developing agent G moves to the upstream of the second chamber 54 via the first connecting portion A. The developing agent moves to the upstream of the second chamber 54 and then to the downstream thereof together with supply toner supplied from the toner supply opening 44. The developing agent is, then, moved to the upstream of the first chamber 53 via the second connecting portion B. The sequence of circulation of the developing agent G described above is repeated as necessary.

After the developing process as described above, as the toner image on the photoconductive drum 1 comes to a position opposite a primary transfer bias roller 9 via the intermediate transfer belt 8, the toner image is primarily transferred onto the intermediate transfer belt 8. This process is a so-called primary transfer process. After the primary transfer process, a small amount of toner, which has not been transferred onto the intermediate transfer belt 8 during the primary transfer process, remains on the photoconductive drum 1.

As the photoconductive drum 1 rotates, a cleaning blade 2*a* of a cleaning device 2 collects the residual toner on the surface of the photoconductive drum 1 (a cleaning process). As the photoconductive drum 1 rotates further, the surface of the photoconductive drum 1 comes to a position opposite a charge eraser, not illustrated, and the charge eraser removes residual potential remaining on the surface of the photoconductive drum 1, thereby completing a sequence of the image forming process.

Four process cartridges 6Y, 6M, 6C, and 6K perform the same image forming sequence as described above, differing only in the color of toner employed. As illustrated in FIG. 1, the exposure device 7 disposed below the process cartridges 6Y through 6K illuminates the photoconductive drums 1 of the process cartridges 6Y through 6K with light L based on image information of a document. More specifically, the exposure device 7 projects the light L from a light source. A polygon mirror scans the light L projected from the light source to illuminate the photoconductive drums 1 via a plurality of optical elements while the polygonal mirror rotates. Then, after the developing process, the toner images of each color formed on the photoconductive drums 1 are primarily transferred onto the intermediate transfer belt 8 so that they are superimposed one atop the other, thereby forming a composite toner image.

Referring back to FIG. 1, a description is provided of the intermediate transfer unit 15. The intermediate transfer unit 15 includes the intermediate transfer belt 8, four primary transfer bias rollers 9Y, 9M, 9C, and 9K, a secondary transfer backup roller 12, an opposing roller 13, a tension roller 14, and a cleaning device 10, and so forth. The intermediate transfer belt 8 is formed into a loop, and wound around and stretched between three rollers 12, 13, and 14. Rotation of the roller 12 enables the intermediate transfer belt 8 to move endlessly in the counterclockwise direction indicated by an arrow in FIG. 1.

Four primary transfer bias rollers 9Y, 9M, 9*c*, and 9K are disposed each facing the photoconductive drums 1Y, 1M, 1C, and 1K, respectively, via the intermediate transfer belt 8 to form a primary transfer nip therebetween. The primary transfer bias rollers 9Y, 9M, 9*c*, and 9K are supplied with a transfer bias opposite a polarity of the toner. As the intermediate transfer belt 8 moves in the direction indicated by the arrow, passing through the primary transfer nips between the primary transfer bias rollers 9Y, 9M, 9C, and 9K, and the photoconductive drums 1Y, 1M, 1C, and 1K, the toner images formed on the photoconductive drums 1Y, 1M, 1C, and 1K are transferred onto the intermediate transfer belt 8 so that they are superimposed one atop the other, thereby forming the composite toner image on the surface of the intermediate transfer belt 8.

Subsequently, the intermediate transfer belt 8 bearing the composite toner image comes to a secondary transfer nip defined by a secondary transfer roller 19 and the secondary transfer backup roller 12. At the secondary transfer nip, the intermediate transfer belt 8 is sandwiched between the secondary transfer backup roller 12 and the secondary transfer roller 19. Subsequently, the composite toner image formed on the intermediate transfer belt 8 is transferred onto a recording medium P supplied to the secondary transfer nip.

Some toner having not been transferred onto the recording medium P remains on the intermediate transfer belt 8. As the intermediate transfer belt 8 passes the cleaning device 10 which collects the residual toner that has not been transferred, the residual toner is collected by the cleaning device 10, thereby completing a sequence of the transfer process.

The recording medium P is supplied from a sheet feeding unit 26 disposed substantially at the bottom of the image forming apparatus 100 and is transported to the secondary transfer nip by a sheet feed roller 27, a pair of registration rollers 28, and so forth. In the sheet feeding unit 26, a plurality of transfer sheets such as recording media sheets P is stacked. As the sheet feed roller 27 rotates in the counterclockwise direction in FIG. 1, the sheet feed roller 27 picks up a top sheet of the stack of recording media sheets in the sheet feeding unit 26 and introduces it to the pair of registration rollers 28.

The pair of registration rollers 28 stops rotation temporarily to hold the recording medium P therebetween. As rotation of the pair of registration rollers 28 resumes, the recording medium P is introduced to the secondary transfer nip in appropriate timing such that the recording medium P is aligned with the composite toner image formed on the intermediate transfer belt 8. Accordingly, the composite toner image (color image) is transferred onto the recording medium P.

Subsequently, the recording medium P on which the composite toner image is transferred in the secondary transfer nip is conveyed to the fixing device 20. Then, the composite toner image transferred onto the recording medium P is fixed on the recording medium P with heat and pressure by a fixing roller and a pressing roller of the fixing device 20, thereby fixing the color image on the recording medium P. The recording medium P on which the color image is fixed is discharged outside the image forming apparatus 100 by a pair of sheet discharge rollers 29. The recording medium P on which the color image is fixed is discharged onto a sheet stack portion 30 outside the image forming apparatus 100, thereby completing a sequence of image forming processes in the image forming apparatus 100.

According to the illustrative embodiment, the image forming apparatus 100 includes cooling fans 61, 62, and 63 (shown in FIG. 1) serving as cooling devices inside thereof. The cooling fans 61 through 63 circulate air inside the image forming apparatus 100 to cool down devices disposed inside the image forming apparatus 100. With reference to FIGS. 1 and 2, a description is provided of the cooling fans 61 through 63. The cooling fan 61 cools down mainly the plurality of developing devices 5 (process cartridges 6). The cooling fan 62 cools down mainly the fixing device 20. The cooling fan 63 cools down mainly the exposure device 7. The cooling fans 61 through 63 are controlled individually.

Figure 4:
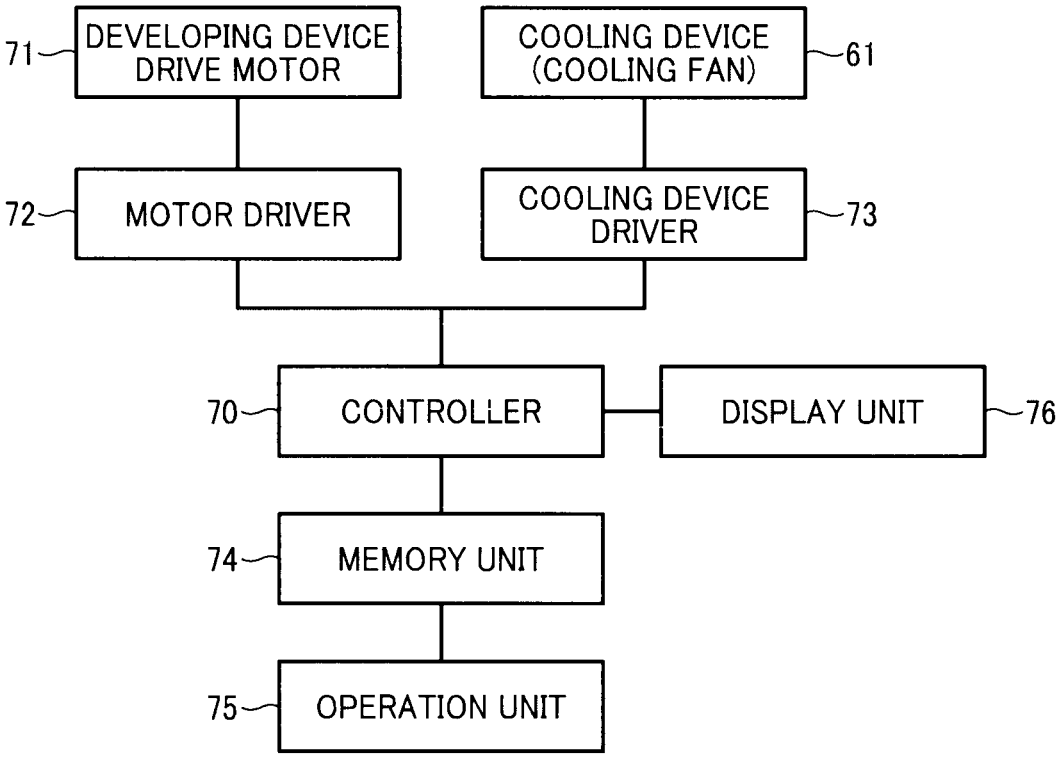
FIG. 4 is a block diagram illustrating a control system of a cooling device according to an illustrative embodiment of the present invention.
Figure 5:
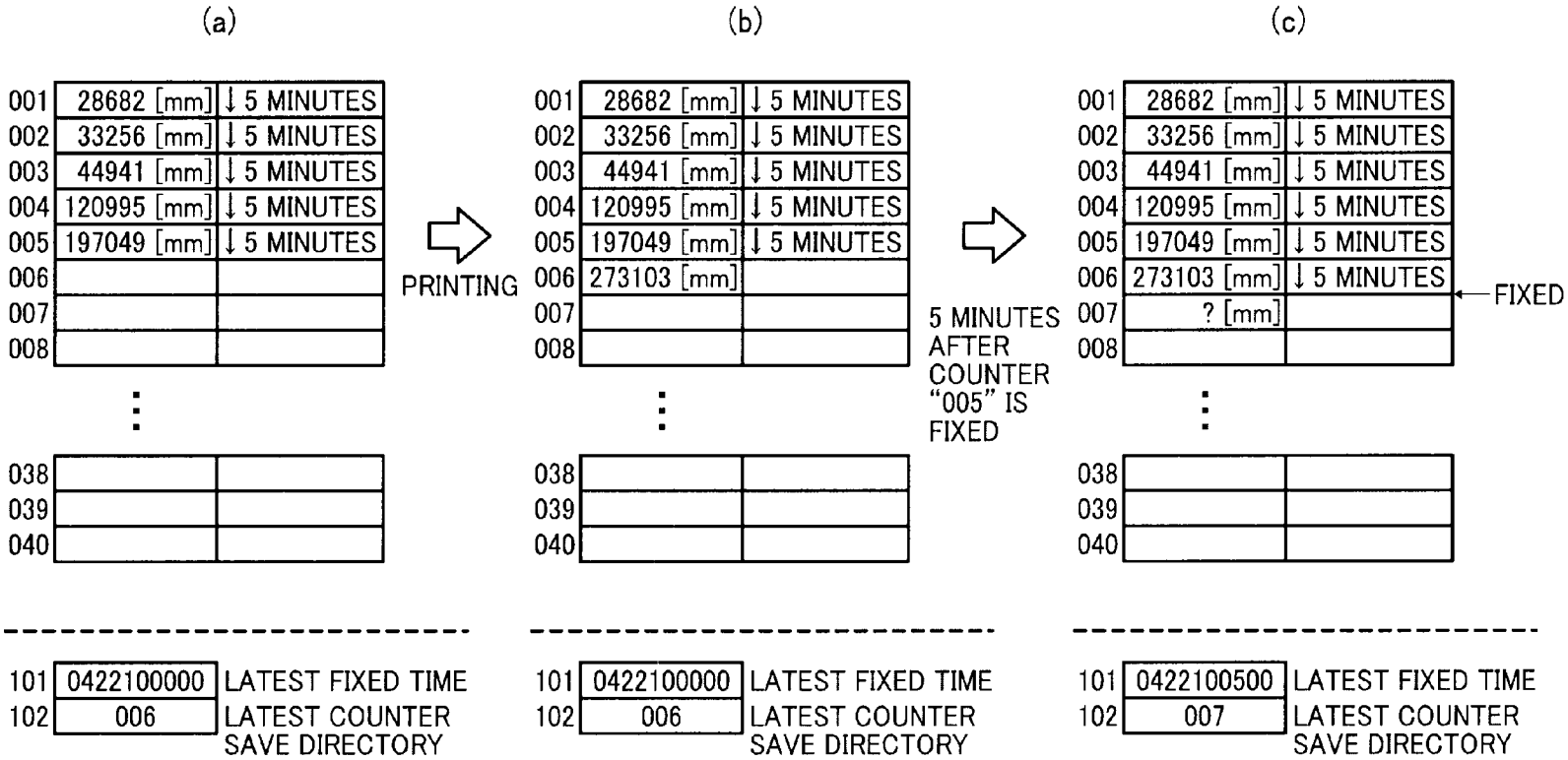
FIGS. 5(*a*) through 5(*c*) are schematic diagrams for explaining a process of storing a total travel distance of a developing roller of the developing device according to an illustrative embodiment of the present invention.
Figure 6:
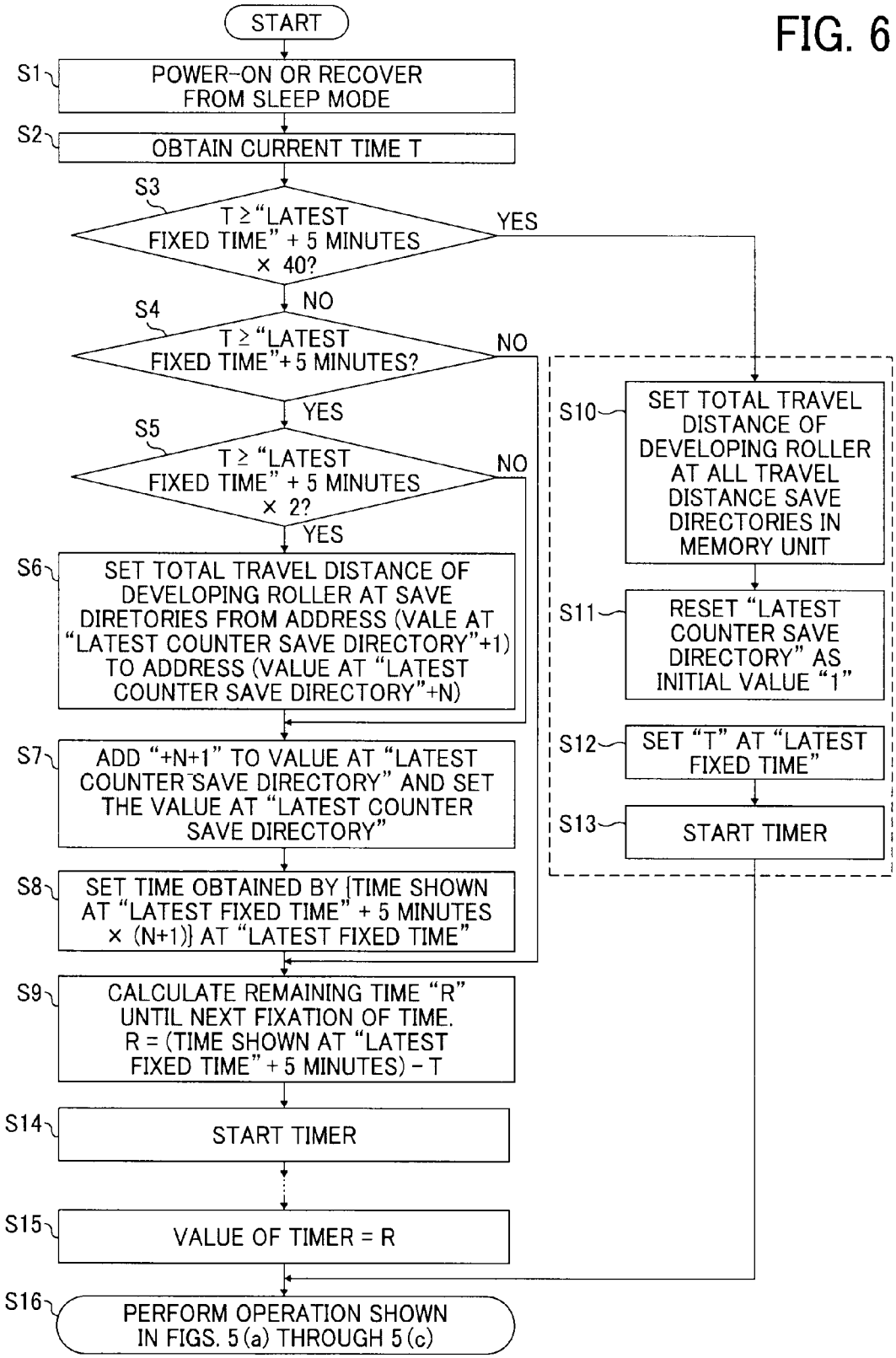
FIG. 6 is a flowchart illustrating example steps in a process of storing a total travel distance of the developing roller after the power is on or after returning to operation from a sleep mode according to the illustrative embodiment.

With reference to FIGS. 4 through 7, a description is provided of control of the image forming apparatus 100. FIG. 4 is a block diagram illustrating a control system of a cooling device according to an illustrative embodiment of the present invention. FIGS. 5(*a*) through 5(*c*) are schematic diagrams for explaining a process of storing a total travel distance of the developing roller 51 of the developing device 5. FIG. 6 is a flowchart illustrating example steps in storing a total travel distance of the developing roller 51 after the power is on or after returning to operation from a sleep mode. FIG. 7A is a flowchart showing example steps in determination of operation of the cooling fan. FIG. 7B is a table showing a portion of the memory unit 74 associated with FIG. 5.

With reference to FIG. 4, a description is provided of the cooling fan 61. As illustrated in FIG. 4, the cooling fan 61 for cooling down the developing device 5 (process cartridge 6) is controlled by a cooling device driver 73 of a controller 70. More particularly, an ON/OFF operation of the cooling fan 61 is controlled by the cooling device driver 73. The controller 70 controls a drive motor 71 for driving the developing device 5 via a motor driver 72, thereby controlling rotation of the developing roller 51 serving as a developing agent bearing member. In other words, the controller 70 enables and stops operation of the developing roller 51 and the cooling fan 61. Although not illustrated, the controller 70 controls overall operation of devices in the image forming apparatus 100 including the cooling fans 62 and 63.

The controller 70 calculates a travel distance of the developing roller 51. According to an illustrative embodiment of the present invention, based on a drive time of the developing roller 51 and its linear velocity (driving linear velocity) of the outer circumference surface of the developing roller 51, a travel distance of the developing roller 51 is calculated. Subsequently, the total travel distance of the developing roller 51 at predetermined time intervals is stored in the memory unit 74 serving as a storage unit. It is to be noted that the memory unit 74 stores a start time for initiating the cooling fan 61 after the image forming operation and operating conditions for the cooling fan 61. The image forming apparatus includes an operation unit (operation panel) 75 and a display unit (display panel) 76. A user or service personnel can arbitrarily set control conditions of the controller 70 through the operation unit 75. The display unit 76 shows the information including activities taking place in the image forming apparatus 100 for the user or the service personnel.

According to the illustrative embodiment, the cooling fan 61 is controlled in accordance with the total travel distance of the developing roller 51. More specifically, the controller 70 calculates the total travel distance of the developing roller 51 for every predetermined interval Y (minutes) within a certain time period, for example, within the last elapsed period of time X (minutes), and stores the result in the memory unit 74. Subsequently, the controller 70 calculates the most recent total travel distance of the developing roller 51 during a given time period ago (Z minutes ago) by obtaining a difference Δ between the most recent total travel distance of the developing roller 51 calculated by the controller 70 and the total travel distance stored Z minutes ago by the memory unit 74.

When the result (the most recent total travel distance of Z minutes, that is, the difference Δ ) is equal to or greater than a threshold value M, the controller 70 controls the cooling fan 61 such that the cooling fan 61 operates for W minute(s) even after the image forming operation (printing operation) is finished. According to the illustrative embodiment, X, Y, Z, M, and W represent constants of 200 (minutes), 5 (minutes), 65 (minutes), 276840 (mm), and 30 (minutes), respectively, as reference values.

More specifically, the controller 70 calculates the total travel distance of the developing roller 51 every 5 minutes in the last 200 minutes and stores the results in the memory unit 74. Subsequently, the controller 70 calculates the most recent total travel distance of the developing roller 51 for the period of 65 minutes by obtaining a difference Δ between the most recent total travel distance of the developing roller 51 calculated by the controller 70 and the total travel distance of 65 minutes ago stored in the memory unit 74.

If the result (the difference Δ) is equal to or greater than the threshold value of 276840 mm, it is assumed that continuous operation time is relatively long so that an increase in the temperature of the developing device 5 is significant, causing the toner in the developing device 5 to melt easily. Therefore, the operation of the cooling fan 61 is extended. That is, the cooling fan 61 is operated for another 30 minutes after the image forming operation. If 30 minutes have elapsed since the additional operation of the cooling fan 61 was initiated and the total travel distance of the developing roller 51 for the last 65 minutes is equal to or less than the threshold value of 276840 mm, it is assumed that the temperature of the developing device 5 has dropped sufficiently. In such a case, the additional operation of the cooling fan 61 is canceled, and the operating time of the cooling fan 61 is returned to a normal setting, that is, the cooling fan 61 operates during the image forming operation only.

If the result (the difference Δ) is less than the threshold value of 276840 mm, it is assumed that the continuous operating time is relatively short and the rise in the temperature of the developing device 5 is insignificant so that the toner does not melt easily. In such a case, the cooling fan 61 is stopped without the additional operation as the image forming operation is finished.

According to the illustrative embodiment, the total travel distance of the developing roller 51 is obtained as a substitute characteristic of the temperature rise of the developing device 5. Whether an additional operation of the cooling fan 61 is needed is determined based on the total travel distance of the developing roller 51. With this configuration, the cooling fan 61 is operated efficiently while cooling down the developing device 5 efficiently and hence preventing the toner in the developing device 5 from melting undesirably.

With reference to FIGS. 5(*a*) through 5 (*c*), a description is further provided of control of the cooling fan 61. FIGS. 5(*a*) through 5(*c*) illustrate example steps in a process of storing the total travel distance of the developing roller 51 in the memory unit 74 during image forming operation (during printing operation). In FIGS. 5(*a*) through 5(*c*), multiple addresses from "001" through "102" in the memory unit 74 are shown.

As illustrated in FIG. 5(*a*), the total travel distance of the developing roller 51 is stored every 5 minutes (Y minutes) at each address "001" through "005". The time (for example, April 22, 10:00'00") at which storing of the total travel distance of the developing roller 51 at an address "005" is fixed is temporarily saved as "LATEST FIXED TIME" (0422100000) at an address "101". An address "006" is temporarily saved at an address "102" as a save directory ("LATEST COUNTER SAVE DIRECTORY") at which the next travel distance is saved. Subsequently, as illustrated in FIG. 5(B), upon printing operation (image forming operation), the total travel distance (for example, 273103 mm) of the developing roller 51 is saved at the latest address "006", accordingly. As illustrated in FIG. 5(C), 5 minutes (Y minutes) elapse after the travel distance at the address "005" is saved and fixed, and then the total travel distance (273103 mm) at the latest address "006" is fixed and saved. Simultaneously, the time (for example, April 22, 10:05'00") at which the total travel distance of the developing roller 51 at the address "006" is saved and fixed is temporarily saved as the LATEST FIXED TIME (0422100500) at an address "101".

Meanwhile, as the save directory (LATEST COUNTER SAVE DIRECTORY) at which the next travel distance to be saved, an address "007", which is 1 added to the preceding address of "006", is temporarily saved at the address "102".

In summary, the total travel distance of the developing roller 51 is saved as needed at the address shown at the "LATEST COUNTER SAVE DIRECTORY" until 5 minutes elapse after the "LATEST FIXED TIME". After 5 minutes elapse, the total travel distance shown at the address is fixed, and the "LATEST FIXED TIME" is updated with the current time. The "LATEST COUNTER SAVE DIRECTORY" advances by 1.

With reference to FIG. 6, a description is provided of storage of the total travel distance of the developing roller 51 after the power is turned on or after returning to operation from a sleep mode. The sleep mode is a mode in which power consumption of the image forming apparatus 100 is reduced by supplying low power while the rise time thereof is relatively fast.

As illustrated in FIG. 6, when the main power of the image forming apparatus 100 is turned on or the image forming apparatus 100 returns to operation from the sleep mode at Step S1, the current time T is obtained at Step S2. At Step S3, whether the current time T is equal to or greater than a value (the time shown in "LATEST FIXED TIME"+5 minutes×40) is determined. In other words, the current time T is compared with the predetermined constant Z (=200 minutes).

As a result, where the current time T is equal to or greater than the value (the time shown in "LATEST FIXED TIME"+5 minutes×40) ("YES" at Step S3), it is assumed that a halting state or the sleep mode of the image forming apparatus 100 is sufficiently long that the temperature of the developing roller 51 has dropped sufficiently. Subsequently, at Step S10, the total travel distance of the developing roller 51 is set in all save directories for the total travel distance in the memory unit 74. At Step S11, the value at the "LATEST COUNTER SAVE DIRECTORY" is reset with an initial value, that is, the address "001". Then, the value at "LATEST FIXED TIME" is set as "T" at Step S12. Subsequently, at Step S13, the timer is started. Thereafter, at Step S16, the memory unit 74 performs the storing operation (basic operation) as described above with reference to FIG. 5.

By contrast, if the current time T is not equal to or greater than the value (the time shown at "LATEST" FIXED TIME"+5 minutes×40) ("NO" at Step S3), it is assumed that the halting time or the sleep mode of the image forming apparatus 100 is not sufficiently long enough to allow the temperature of the developing device 5 to decrease sufficiently. Subsequently, at Step S5, whether the current time T is equal to or greater than a value (the time shown at "LATEST" FIXED TIME"+5) is determined. In other words, the current time T is compared with the predetermined constant Y (=5 minutes). If the current time T is not equal to or greater than the value (the time shown at "LATEST" FIXED TIME"+5 minutes) ("NO" at Step S4), the step proceeds to Step S9 and the remaining time R until the next fixation of time (that is, fixation of "LATEST FIXED TIME") is calculated as follows: R=("LATEST FIXED TIME"+5)−T. Subsequently, the timer is started at Step S14, and the total travel distance is calculated until the remaining time R elapses. Thereafter, at Step S16, the memory unit 74 performs the storing operation (basic operation) as described above with reference to FIG. 5.

By contrast, if the current time T is equal to or greater than the value (the time shown at "LATEST FIXED TIME"+5 minutes) ("YES" at Step S4), whether the current time T is equal to or greater than a value (the time shown at "LATEST FIXED TIME"+5 minutes×2) is determined at Step S5. Subsequently, if it is determined that the current time T is equal to or greater than a value (the time shown at "LATEST FIXED TIME"+5 minutes×2) at Step S5 ("YES" at Step S5), the total travel distance of the developing roller 51 is set in the save directories from the address (the value at "LATEST COUNTER SAVE DIRECTORY"+1) to the address (the value at "LATEST COUNTER SAVE DIRECTORY"+N) at Step S6.

It is to be noted that "N" is a natural number obtained by (time shown at "LATEST FIXED TIME"+5 minutes)/5 minutes, and is rounded down to the nearest whole number.

Subsequently, "+N+1" is added to the value at "LATEST COUNTER SAVE DIRECTORY", and the value is set at "LATEST COUNTER SAVE DIRECTORY" at Step S7. Then, the time obtained by {time shown at "LATEST FIXED TIME"+5 minutes×(N+1)} is set at "LATEST FIXED TIME" at Step S8. Thereafter, the subsequent steps after Step S9 are performed.

By contrast, if it is determined that the current time "T" is not equal to or greater than the value (time shown at "LATEST FIXED TIME"+5 minutes×2) ("NO" at Step S5), the step proceeds to Step S7 and the subsequent steps are performed.

With this configuration, even when the image forming apparatus is turned off or in the sleep mode, the halting time is calculated and the total travel distance corresponding to the halting time is stored when the power is turned on or when returning to operation from the sleep mode. In other words, even when the operation of the image forming apparatus is restarted after the power is off or after the sleep mode, the halting time is obtained and the travel distance of the developing roller 51 during the halting time is set as zero when the difference Δ between the latest total travel distance and the total travel distance stored a certain time ago is calculated. Accordingly, the total travel distance of the developing roller 51 associated with a given rise in the temperature of the developing device 5 is obtained accurately.

Figure 7A:
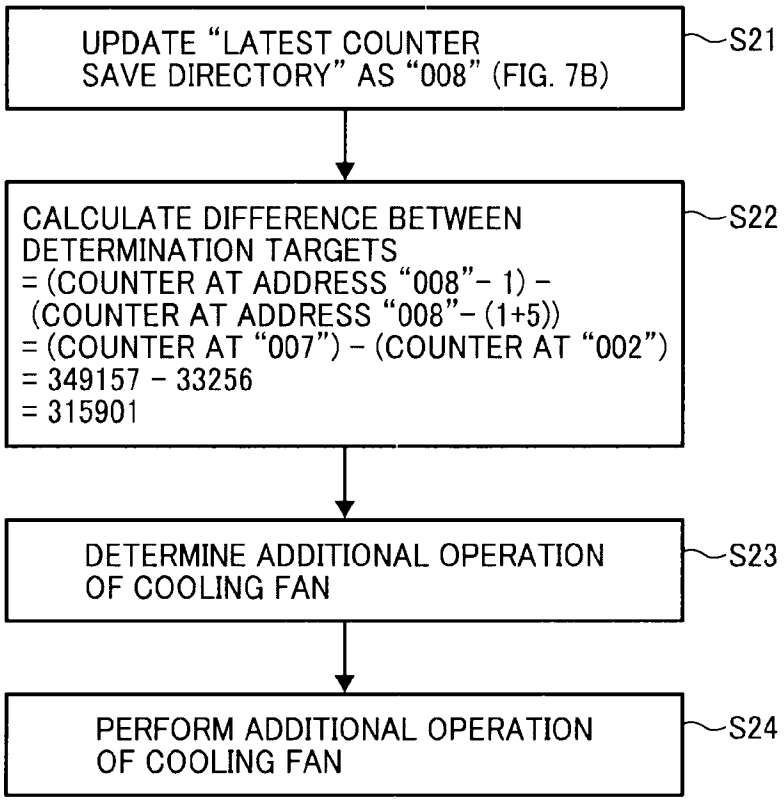
FIG. 7A is a flowchart showing example steps in determination of operation of the cooling fan after image forming operation is finished.
Figure 7B:
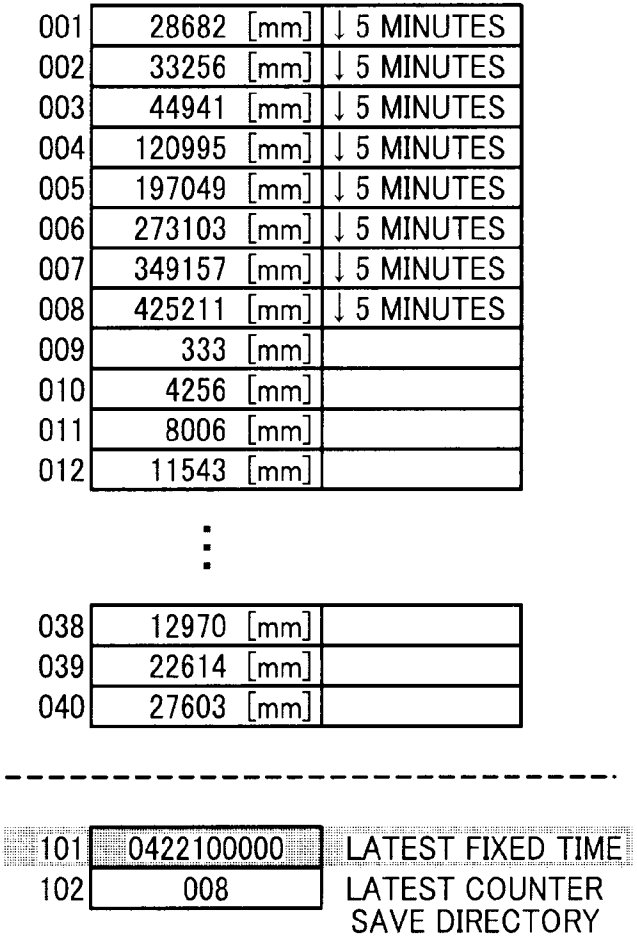
FIG. 7B is a table showing a portion of a memory unit associated with FIG. 5.

With reference to FIGS. 7A and 7B, a description is provided of operation of the cooling fan after the image forming operation. FIG. 7A is a flowchart showing steps in the operation of the cooling fan after the image forming operation is finished. FIG. 7B illustrates a portion of the memory unit 74 (storage member) associated with FIG. 5.

As illustrated in FIG. 7A, at Step S21, the address "008" in "LATEST COUNTER SAVE DIRECTORY", which is saved temporarily at the address "102", is fixed and updated. Subsequently, the difference Δ between two target values for determination of operation of the cooling fan is calculated. Here, the constant Z is 25 minutes (25 minutes/5 minutes=equivalent of 5 addresses). This means subtracting the counter (total travel distance) at the address (the value at "LATEST COUNTER SAVE DIRECTORY"−(1+5)) from the counter (total travel distance) at the address (the value at "LATEST COUNTER SAVE DIRECTORY"−1). In other words, Δ=(the counter at the address "008"−1)−(the counter at the address "008"−(1+5)). As illustrated in FIG. 7A, 315901 mm is obtained as the difference Δ.

Then, the difference Δ (315901 mm) is compared with the threshold value M (276840 mm). Because the difference Δ is greater than or equal to the threshold M (Δ≥M), operation of the cooling fan 61 is extended for another 30 minutes (W minutes) after the image forming operation is finished. Thereafter, each time the image forming operation is finished, the additional operation of the cooling fan 61 is performed for 30 minutes.

Where the difference Δ is greater than or equal to the threshold value M, the memory unit 74 stores the time at which the cooling fan 61 is initiated after the image forming operation. When 30 minutes elapse after this time and the travel distance obtained during the latest determination time interval does not exceed the threshold M, it is assumed that the temperature of the developing device 5 has dropped sufficiently, and hence the operation setting of the cooling fan 61 is reset to the original setting after the image forming operation. In other words, every time the image forming operation (printing operation) is finished, the operation setting for operation of the cooling fan 61 for 30 minutes is canceled. With this configuration, the cooling fan 61 is activated efficiently, depending on the extent of the rise in the temperature of the developing device 5.

According to the illustrative embodiment, at least one of the constants X, Y, Z, M, and W associated with control of the cooling fan 61 can be changed using the operation unit (operation panel) 75 of FIG. 4. That is, the operation unit 75 is accessible by a user or service personnel so that the constants X, Y, Z, M, and W can be changed. With this configuration, fine adjustment of efficient operation of the cooling fan 61 corresponding to the degree of rise in the temperature of the developing device 5 can be performed in accordance with actual operation of the image forming apparatus 100 during operation of the image forming apparatus.

As described above with reference to FIG. 1, the image forming apparatus 100 includes the cooling fans 62 and 63 in addition to the cooling fan 61 for cooling the developing device 5. The cooling fan 61 is disposed below each of the developing devices 5 of the process cartridges 6Y, 6M, 6C, and 6K. Where the difference Δ is greater than or equal to the threshold M, the controller 70 sets the time W for which the cooling fans 61 through 63 or four cooling fans 61 are operated after the image forming operation is finished.

With this configuration, where the difference Δ is greater than or equal to the threshold value M, only the cooling fan 61 for cooling the developing devices 5 can be activated after the image forming operation while other two cooling fans 62 and 63 are stopped, or the operating time for the cooling fans 62 and 63 can be set short. Furthermore, operation of four cooling fans 61 after the image forming operation can be controlled individually to accommodate operation of each of the developing devices 5. For example, for monochrome printing, only the cooling fan 61 facing the developing device 5 for black is controlled.

With this configuration, the cooling fans 61 through 63 can be operated efficiently in accordance with the degree of an increase in the temperature of the developing devices 5. Preferably, the display unit (display panel) 76 may notify the user or the service personnel the additional operation of the cooling fan 61 after the image forming operation when the additional operation of the cooling fan 61 corresponding to the total travel distance of the developing roller 51 is performed. With this configuration, the user or the service personnel can understand that the additional operation of the cooling fan 61 after the image forming operation is not anomalous.

To recapitulate, based on the total travel distance of the developing roller 51 of the developing device 5, the cooling fan 61 operates even after the image forming operation is finished, thereby operating the cooling fan 61 efficiently and preventing the temperature of the developing device 5 from rising. Accordingly, the toner in the developing device 5 does not melt undesirably.

According to the illustrative embodiment, the present invention is applied to the developing device storing a two-component developing agent. Alternatively, the present invention may be applied to a developing device storing a single component developing agent. The same effect as that of other foregoing embodiments can be achieved.

According to the illustrative embodiment, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a latent image on a surface thereof and rotate in a certain direction;

a developing device including a developing roller to bear a developing agent to develop the latent image formed on the image bearing member using the developing agent to form a toner image;

a cooling device to reduce an internal temperature of the image forming apparatus by blowing air;

a controller to calculate the total travel distance of the developing roller every predetermined interval Y within a last elapsed period of time X and calculate a difference D between the latest total travel distance of the developing roller and the total travel distance stored a given time period Z ago by a memory so as to obtain the total travel distance during Z, the controller operating the cooling device for a predetermined period of time W after image forming operation ends where the difference D is equal to or greater than a threshold value M; and the memory to store the total travel distance of the developing roller obtained by the controller.

2. The image forming apparatus according to claim 1, further comprising an operation unit through which a user sets control conditions of the controller, wherein at least one of the elapsed period of time X, the predetermined interval Y, the given time period Z, the threshold value M, and the predetermined period of time W during which the cooling device is operated is changeable in the operation unit.

3. The image forming apparatus according to claim 1, further comprising a plurality of cooling devices, wherein the predetermined period of time W during which the cooling device is operated is set individually for each cooling device, and where the difference in the total travel distance is equal to or greater than the threshold value M, the controller operates the plurality of cooling devices for the predetermined period of time W.

4. The image forming apparatus according to claim 1, wherein where the difference D in the total travel distance is equal to or greater than the threshold value M, the memory stores a time at which the cooling device starts to operate after image forming operation ends.

5. The image forming apparatus according to claim 1, further comprising a display to display information notifying a user of operation of the cooling device after image forming operation ends.

6. An image forming apparatus, comprising:

bearing means for bearing a latent image;

developing means for developing the latent image using a developing agent to form a toner image;

cooling means for reducing an internal temperature of the image forming apparatus by blowing air;

controlling means for calculating the total travel distance of a developing roller every predetermined interval Y within a last elapsed period of time X and calculating a difference D between the latest total travel distance of the developing roller and the total travel distance stored a given time period Z ago so as to obtain the total travel distance during Z, the controlling means operating the cooling means for a predetermined period of time W after image forming operation ends where the difference D is equal to or greater than a threshold value M; and storing means for storing the total travel distance of the developing means obtained by the controlling means.

7. The image forming apparatus according to claim 6, further comprising operating means through which a user sets control conditions of the controlling means, wherein at least one of the elapsed period of time X, the predetermined interval Y, the given time period Z, the threshold value M, and the predetermined period of time W during which the cooling means is operated is changeable in the operating means.

8. The image forming apparatus according to claim 6, further comprising a plurality of the cooling means, wherein the predetermined period of time W during which the cooling means is operated is set individually for each cooling means, and where the difference in the total travel distance is equal to or greater than the threshold value M, the controlling means operates the plurality of cooling means for the predetermined period of time W.

9. The image forming apparatus according to claim 6, wherein where the difference D in the total travel distance is equal to or greater than the threshold value M, the storing means stores a time at which the cooling means starts to operate after image forming operation ends.

10. The image forming apparatus according to claim 6, further comprising means for displaying information notifying a user of operation of the cooling means after image forming operation ends.

11. A method for reducing an internal temperature of an image forming apparatus, the method comprising the steps of:

calculating a total travel distance of a developing roller employed in the image forming apparatus every predetermined interval Y within a last elapsed period of time X;

storing the total travel distance of the developing roller;

calculating a difference D between the latest total travel distance of the developing roller and the total travel distance stored a given time period Z ago so as to obtain the total travel distance during Z;

operating a cooling device employed in the image forming apparatus for a predetermined period of time W after image forming operation ends where the difference D is equal to or greater than a threshold value M; and reducing an internal temperature of the image forming apparatus by blowing air.

12. The method according to claim 11, further comprising changing at least one of the elapsed period of time X, the predetermined interval Y, the given time period Z, the threshold value M, and the predetermined period of time W.

13. The method according to claim 11, further comprising setting the predetermined period of time W individually for each of a plurality of cooling devices, and operating the plurality of cooling devices for the predetermined period of time W where the difference D in the total travel distance is equal to or greater than the threshold value M.

14. The method according to claim 11, wherein the storing stores a time at which the cooling device starts to operate after image forming operation ends where the difference D in the total travel distance is equal to or greater than the threshold value M.

15. The method according to claim 11, further comprising displaying information notifying a user of operation of the cooling device after image forming operation ends.

* * * * *